US005447422A

United States Patent [19]

Aoki et al.

[11] Patent Number: 5,447,422

[45] Date of Patent: Sep. 5, 1995

[54] AIR-COOLED OIL-FREE ROTARY-TYPE COMPRESSOR

[75] Inventors: Masakazu Aoki; Akira Suzuki, both of Shimizu, Japan

[73] Assignee: Hitachi, Ltd., Tokyo, Japan

[21] Appl. No.: 253,486

[22] Filed: Jun. 3, 1994

Related U.S. Application Data

[63] Continuation of Ser. No. 972,906, Nov. 6, 1992, abandoned.

[30] Foreign Application Priority Data

Nov. 8, 1991 [JP] Japan ..... 3-292905

[51] Int. Cl.[6] ..... F04C 29/02; F04C 29/04

[52] U.S. Cl. ..... 418/83; 418/85; 418/101; 165/122; 165/176; 165/910

[58] Field of Search ..... 418/83, 85, 101, 270, 418/86; 417/313; 165/122, 910, 176

[56] References Cited

U.S. PATENT DOCUMENTS

| | | | |
|---|---|---|---|
| 3,835,920 | 9/1974 | Mondt | 165/176 |
| 3,839,880 | 10/1974 | Premaza | 165/122 |
| 4,002,198 | 1/1977 | Wagner et al. | 165/176 |
| 4,385,505 | 5/1983 | Umezu et al. | 165/122 |
| 4,929,161 | 5/1990 | Aoki et al. | 418/83 |

FOREIGN PATENT DOCUMENTS

| | | | |
|---|---|---|---|
| 1035120 | 8/1953 | France | 165/176 |
| 155195 | 5/1992 | Japan | 165/176 |

*Primary Examiner*—Richard A. Bertsch
*Assistant Examiner*—Roland G. McAndrews, Jr.
*Attorney, Agent, or Firm*—Antonelli, Terry, Stout & Kraus

[57] ABSTRACT

An air-cooled oil-free rotary-type compressor in accordance with the invention includes a first air cooler including a plurality of cooling pipes, a check valve, and a second air cooler. The first air cooler, the check valve and the second air cooler are provided in a passage of compressed air discharged from a compressor body. The second air cooler is disposed in a first cooling air flow direction and the second air cooler is disposed in a second cooling air flow direction substantially perpendicular to the first cooling air flow direction. The plurality of cooling pipes of the first air cooler are arranged along the second cooling air flow direction.

9 Claims, 7 Drawing Sheets

AIR-COOLED OIL-FREE ROTARY-TYPE COMPRESSOR

This is a continuation of application Ser. No. 972,906, filed Nov. 6, 1992, now abandoned.

BACKGROUND OF THE INVENTION

The present invention relates to an air-cooled oil-free rotary-type compressor and, more particularly, to an air-cooled oil-free rotary-type compressor which is suitable for improving the heat exchange efficiency of a first air cooler and reducing its size.

In, for example, Japanese Patent Unexamined Publication No. 1-116297, a conventional air-cooled oil-free rotary-type compressor is provided wherein a first cooler is provided at a downstream side of a second air cooler, a coolant cooler and an air-cooler with respect to a flow direction of the cooling air. Therefore, the cooling air, flowing to the first air-cooler via the second air-cooler, the coolant cooler and the oil cooler, has a relatively low velocity. Consequently, with a plurality of cooling pipes of the first air cooler being arranged in a direction perpendicular to the flowing direction of the cooling air, an adequate heat exchange is not effected between the compressed air and the cooling air. For this reason, the heat exchange efficiency of the conventional compressor is so low that an increase in the size of the first air cooler cannot be avoided.

In this connection, when the flow velocity of the cooling air flowing between the row of cooling pipes of the first air cooler is increased by narrowing a discharge-side passage of the cooling air, the heat exchange efficiency can be improved. However, when the cross section of the discharge-side passage of the cooling air is reduced and the cooling pipes are arrayed in the reduced discharge-side passage without changing the orientation of the cooling pipes of the first air-cooler with respect to the flowing direction of the cooling air, it is necessary to substantially reduce the pitches of the cooling pipes. If the pitches of the cooling pipes are thus reduced, there will be caused a new problem that the flow resistance of the cooling air is increased, as well as a manufacturing problem that the welding operation of the pipes is difficult.

SUMMARY OF THE INVENTION

The aim underlying the present invention essentially resides in providing an air-cooled oil-free rotary-type compressor which avoids, by simple means, the disadvantages encountered in the prior art and improves the heat exchange efficiency of the first air-cooler, and reduces the size of the same, while also being simple to manufacture.

The above-noted aim may be achieved by arraying a plurality of cooling pipes of a first air-cooler along a flow direction of the cooling air. Advantageously, in accordance with further features of the present invention, the first air-cooler is located at the discharge side of the cooling air which has passed at least one of a second air-cooler, a coolant cooler for cooling a coolant for cooling a casing of a compressor body, and an oil cooler for cooling a lubricating oil for lubricating bearings, gears and the like inside of the compressor body. A cooling air discharge duct is arranged such that the cooling air, which has been blown horizontally, will be directed to flow vertically upwardly at the discharge side, with the first air-cooler including the cooling pipes arrayed along the flowing direction of the cooling air being located in the cooling air discharge duct. The plurality of cooling pipes of the first air-cooler are mounted to have the same alternate displacement with respect to the adjacent pipes, in a direction perpendicular to the flow direction of the cooling air or the plurality of cooling pipes of the first air-cooler are mounted to have the same slight displacement with respect to the adjacent pipes of the downstream side in a direction perpendicular to the flowing direction of the cooling air. A portion of the cooling air discharge duct at the discharge side is shaped to makes its cross sectional area diminish gradually in the flow direction of the cooling air and the first air cooler is arranged in the portion of the duct having the gradually diminishing cross-sectional area.

According to the present invention, since the plurality of cooling pipes of the first air cooler are arranged along the flow direction of the cooling air, the flow velocity of the cooling air flowing around the cooling pipe of the first air cooler can be largely increased, so that the compressed air flowing in the first air cooler and the cooling air can efficiently exchange heat. As a result, it is possible to improve the heat exchange efficiency of the first air cooler, and accordingly, it is also possible to reduce the size of the first air cooler. Besides, it is not necessary to reduce the pitches of the cooling pipes of the first air cooler. Therefore, the manufacturing problem in the welding and fixing operation of the cooling pipes will not be induced.

Also, since the first air cooler is located at the discharge side of the cooling air which has passed at least one of the second air cooler, the coolant cooler and the oil cooler, it is possible to improve the heat exchange efficiency of the first air cooler and to reduce its size, as described above, it is also possible to solve the manufacturing problem.

Further, the cooling air discharge duct is provided such that the cooling air, which has blown horizontally, will be directed vertically upwardly at the discharge side, and the first air cooler is located in the air discharge duct. Consequently, it is possible to improve the heat exchange efficiency of the first air cooler and reduce its size as described above. It is also possible to solve the manufacturing problem.

Moreover, the plurality of cooling pipes of the first air cooler are mounted to be alternately displaced with respect to the adjacent pipes, in a direction perpendicular to the flowing direction of the cooling air, so that the welding operation for attachment of the plurality of cooling pipes can be further improved.

The plurality of cooling pipes of the first air cooler are mounted to be slightly displaced with respect to the adjacent pipe of the downstream side in a direction perpendicular to the flowing direction of the cooling air, so that they are hard to be affected by heat generated from the upstream cooling pipes and turbulence of the cooling air. Therefore, heat exchange can be effected with a higher efficiency.

Furthermore, the portion of the cooling air discharge duct, at the discharge side, is shaped to have a cross-sectional area which gradually diminishes in the flow direction of the cooling air, and the first air cooler is provided in this area of the duct. Consequently, the flow velocity of the cooling air flowing around the cooling pipes is increased, to thereby make the heat exchange even higher.

DESCRIPTION OF PREFERRED EMBODIMENTS

Figure 8:
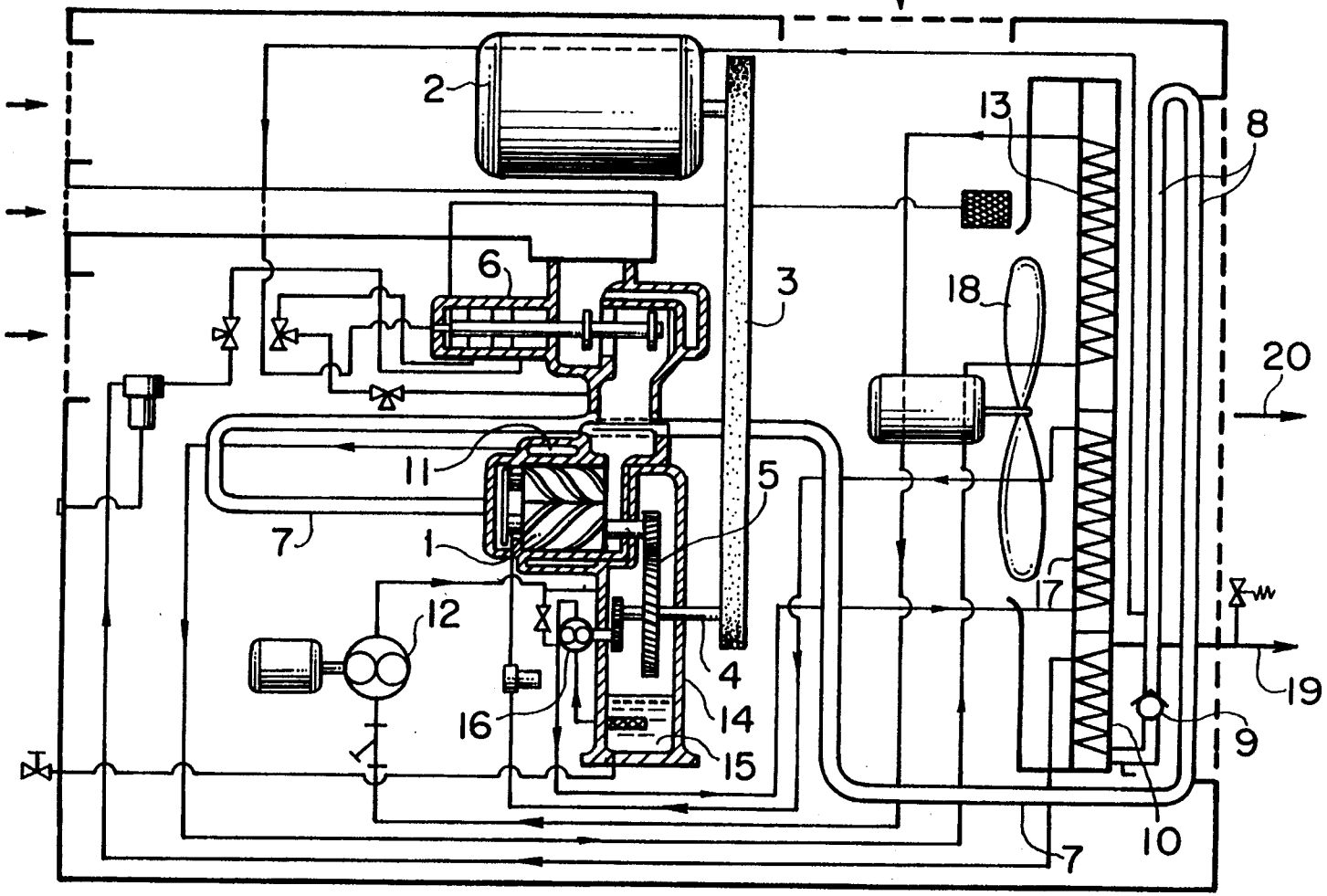
FIG. 8 PRIOR ART
FIG. 8 is a schematic system diagram of a conventional air-cooled oil-free, rotary-type compressor.

As shown in FIG. 8, a conventional compressor comprises a compressor body 1, a drive unit which includes a motor 2, a V-belt 3, a rotational shaft 4 and a transmission gearing 5, and which rotates/drives the compressor body 1, a discharge piping 7 which constitutes a passage of discharged gas from the compressor body 1, a first air cooler 8, a second air cooler 10, a check valve 9 provided on the discharge piping 7 between the first and second air coolers 8 and 10, a jacket 11 formed on a casing for the compressor body 1, a coolant pump 12 for circulating the cooling liquid (hereinafter coolant) in the jacket 11, an air-cooled cooler 13 for cooling the coolant (hereinafter a coolant cooler), an oil tank 15 formed at the bottom of a transmission casing 14 for storing lubricating oil, an oil pump 16 for supplying the lubricating oil to bearings, gears and the like inside the compressor body 1, an oil cooler 17 for cooling the lubricating oil, and the cooling fan 18.

In the example of FIG. 8, compressed air 19, whose temperature is raised to a high temperature (about 300° C.) by being compressed in the compressor body 1, passes through the discharge piping 7 and enters the first air cooler 8 where it is cooled to about 150° C., then flowing to the check valve 9. Subsequently, the compressed air 19 enters the second air cooler 10 where the compressed air 19 exchanges heat with the cooling air 20 to have a temperature of 10°–15° C. higher than the atmospheric temperature, and is discharged out of the compressor. The first air cooler 8 is located at the cooling air discharge side of the second air cooler 10, the oil cooler 17 and the coolant cooler 13, and is made of stainless steel pipes to withstand a temperature of about 300° C.

The first air cooler 8 consists of a plurality of generally U-shaped cooling pipes **8*a* which are located between headers 8*b* and 8*c* and secured thereto by welding. The set of cooling pipes 8*a* are supported by supports 8*d* and are fixed to a base. With this structure, the high-temperature compressed air 19, discharged from the compressor body 1, flowing onto the first air cooler 8 in a direction indicated by the arrow 8*e*, is cooled by the cooling air 20 flowing to this side from the back in a direction perpendicular to the plane of FIG. 9, and is discharged in a direction indicated by the arrow 8*f***.

In this manner, with respect to the flowing direction of the cooling air 20, the first air cooler 8 is located at the downstream side of the second air cooler 10, the coolant cooler 13 and the oil cooler 17. Therefore, the cooling air 20, has flowed to the first air cooler 8 via the second air cooler 10 the coolant cooler 13 and the oil cooler 17, has a relatively low flow velocity.

Consequently, when the plurality of cooling pipes **8*a* of the first air cooler 8 are arranged in a direction perpendicular to the flowing direction of the cooling air 20, adequate heat exchange is not effected between the compressed air 19 and the cooling air 20. For this reason, the heat exchange efficiency of the conventional compressor is so low that an increase in the size of the first air cooler 8** cannot be avoided.

Figure 1:
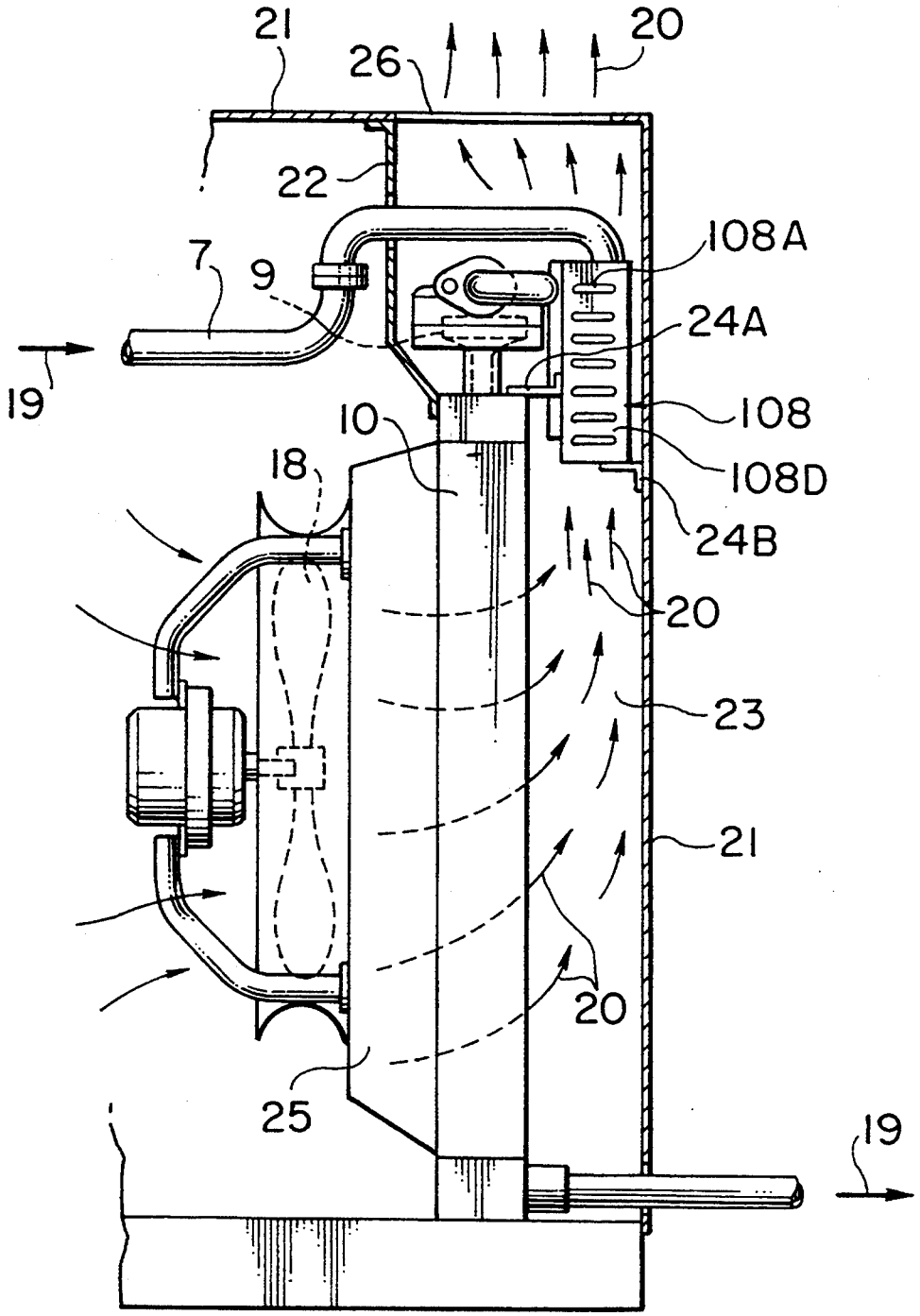
FIG. 1 is a partial cross-sectional front view of a first embodiment of the present invention with a compressor sound-proof wall.
Figure 2:
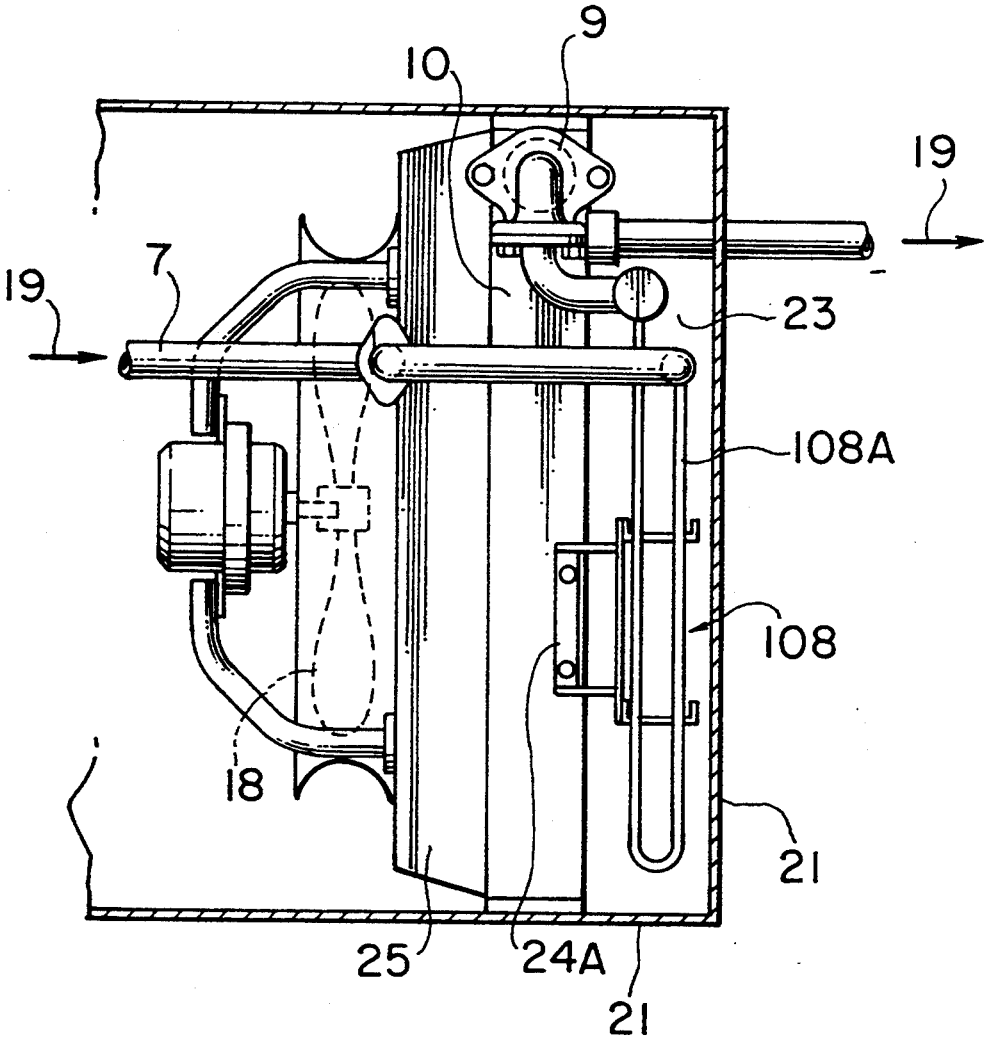
FIG. 2 is a plan view of a portion of the embodiment shown in FIG. 1.
Figure 3:
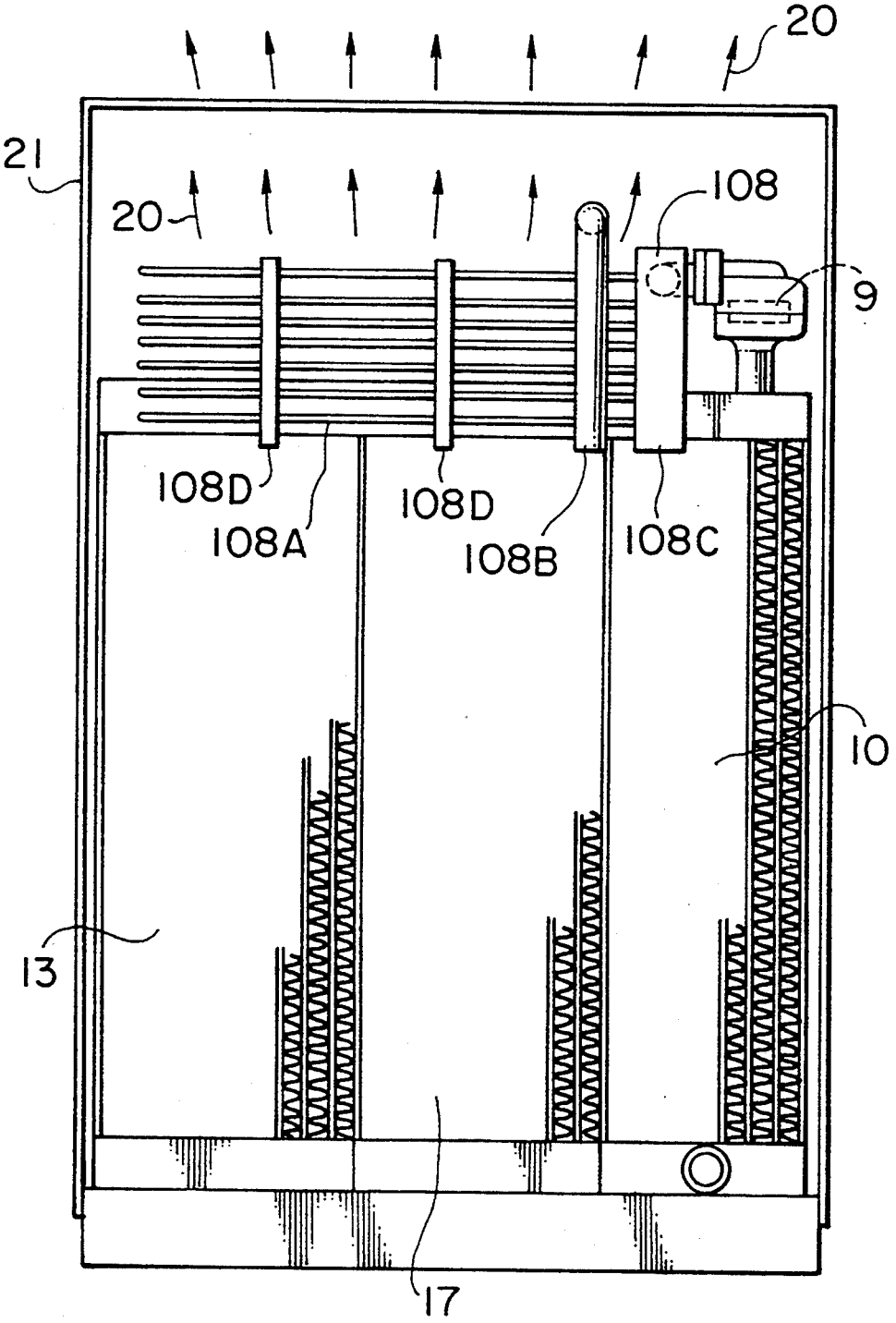
FIG. 3 is a side view of a portion of the embodiment of FIG. 1, as viewed from an outlet side of the compressed air.

The air-cooled oil-free rotary-type compressor of the embodiment of FIGS. 1–3 includes a fan duct 25, provided at the downstream side of a cooling fan 18, a second air cooler 10, an oil cooler 17 and a coolant cooler 13 located at the downstream side of the fan duct 25, a compressor sound-proof wall 21, a cooling air discharge duct 23 defined by a partition plate 22 and formed at the air discharge side of the sound-proof wall 21, and a first air cooler 108 provided in the cooling air discharge duct 23.

The first air cooler 108 is connected to a compressor by a discharge piping 7 which constitutes a discharged gas passage of the compressed air 19. Further, a check valve 9 is provided on the discharge piping 7 between the first air cooler 108 and the second air cooler 10.

The cooling air discharge duct 23 is constructed in such a manner that the cooling air 20, blown horizontally by the cooling fan 18, flows from the fan duct 25 and passed the second air cooler 10, the coolant cooler 13 and the oil cooler 17, is turned to flow vertically upwardly. As shown in FIG. 1, an air discharge port 26 is provided on the top of the cooling air discharge duct 23.

The first air cooler 108 includes a plurality of generally U-shaped cooling pipes 108A as shown in FIG. 2, with the U-shaped cooling pipes 108A being disposed along a flow direction of the cooling air flowing in the cooling air discharge duct 23, as shown in FIGS. 1 and 3. The respective ends of each cooling pipe 108A are welded and secured to the headers 108B, 108C, as shown in FIGS. 2 and 3. Also, as shown in FIGS. 1 and 3, the set of cooling pipes 108A are bundled by supports 108D. One of the two supports 108D is securely fixed on a base at the top of the second air cooler 10 through a fixing member 24A and the other of the supports 108D is securely fixed on an inner surface of the compressor sound-proof wall 21 through a fixing member **24*b*. Then, the first air cooler 108 including the cooling pipes 108A arranged along the flow direction of the cooling air 20, as described above, is provided in an upper portion of the cooling air discharge duct 23**.

In the air-cooled oil-free rotary-type compressor of the embodiment of FIGS. 1–3, the high-temperature compressed air 19 which has been compressed in a compressor body (not shown in FIGS. 1 to 3) passes through the discharge piping 7 and enters the first air cooler 108.

On the other hand, the cooling air which has been blown by the cooling fan 18 flows horizontally from the fan duct 25, as shown in FIG. 1, and passed around the second air cooler 10, the coolant cooler 13 and the oil cooler 17 so as to exchange heat with the compressed air 19 flowing in the second air cooler 10, cooling flowing in the coolant cooler 13, and lubrication oil flowing in the oil cooler 17, respectively to thereby cool the cooling air 20, compressed air 19 and lubricating oil. The cooling air 20, which has passed the second air cooler 10, the coolant cooler 13 and the oil cooler 17, flows horizontally, and is directed vertically upwardly by the cooling air discharge duct 23 as shown in FIG. 1, thereby flowing from the bottom toward the top of the set of cooling pipes 108A of the first air cooler 108. The flow resistance of the cooling air 20 at the time is small because the cooling pipes 108A of the first air cooler 108 are arranged along the flowing direction of the cooling air 20 flowing in the cooling air discharge pipe 23. Consequently, the flow velocity of the cooling air 20 flowing around the cooling pipes 108A can be largely increased. As a result, the compressed air 19 flowing in the cooling pipes 108A and the cooling air 20 greatly exchange heat with each other. Thus, it is possible to improve the heat exchange efficiency of the first air cooler 108 and to reduce the size of the first air cooler 108.

After exchanging heat with the compressed air 19 flowing in the cooling pipes 108A of the first air cooler 108, the cooling air 20 is discharged to the atmosphere through the discharge port 26 provided on the top of the cooling air discharge duct 23. On the other hand, the compressed air 19, which has been cooled in the first air cooler 108, passes through the check valve 9 and enters the second air cooler 10 where it further exchanges heat with the cooling air 20. After the compressed air 19 is thus cooled, the compressed air 19 is removed from the compressor to be supplied to an apparatus in which the compressed air is used.

In general, the efficiency of heat exchange between the cooling air and the compressed air flowing in cooling pipes can be improved by reducing pitches of the cooling pipes of the first air cooler even if the cooling pipes are arranged along a direction perpendicular to a flowing direction of the cooling air. However, a number of problems may arise. More particularly, the flow resistance of the cooling air is increased, and the flow rate of the cooling air is reduced, so that the performance of the first air cooler will be lowered. Furthermore, since the first air cooler is exposed to a high temperature of 300° C. or more, welding must be conducted so that fixed portions of the cooling pipes can also endure such a high temperature of 300° C. However, when the pitches of the cooling pipes are small, it is very difficult to perform the welding operation, which results in a manufacturing problem. In this respect, the embodiment of FIGS. 1–3 is advantageous in the manufacturing thereof because the heat exchange efficiency can be improved without reducing the pitches of the cooling pipes 108A of the first air cooler 108.

Figure 9:
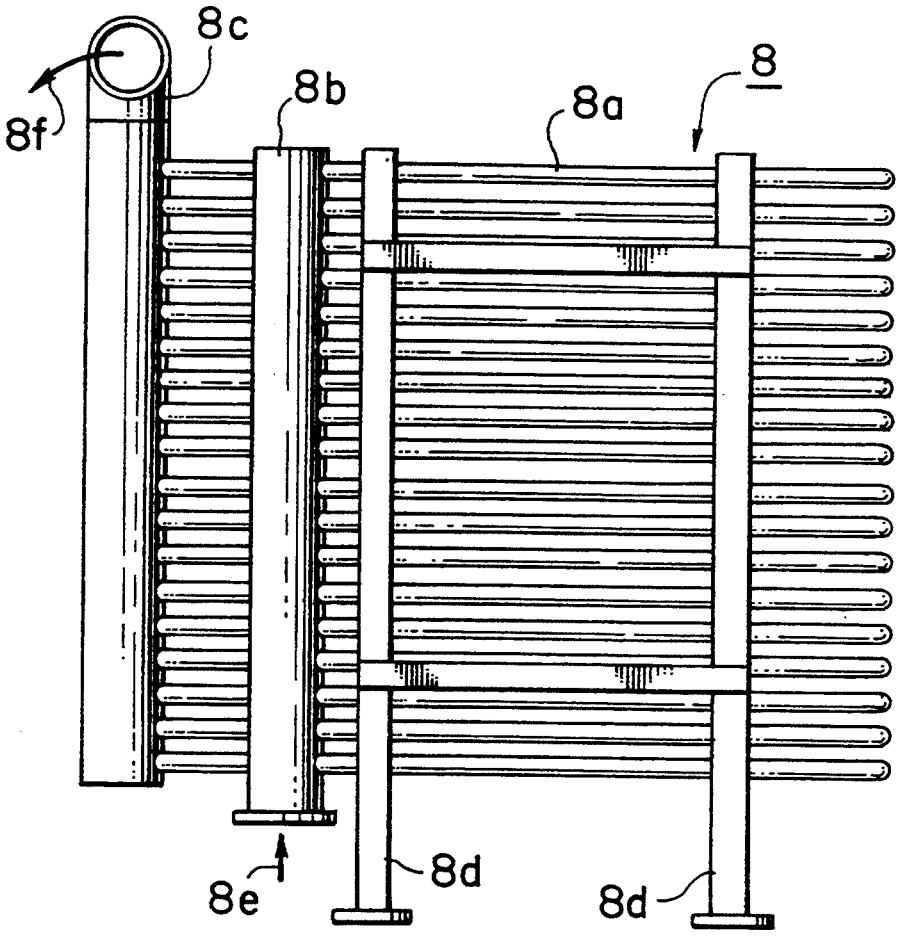
FIG. 9 PRIOR ART
FIG. 9 is a schematic view illustrating a first air cooler in the conventional compressor of FIG. 8.

The remainder of the construction and other functions of the compressor in the embodiment of FIGS. 1–3 are substantially the same as the conventional example of FIGS. 8 and 9.

Figure 4:
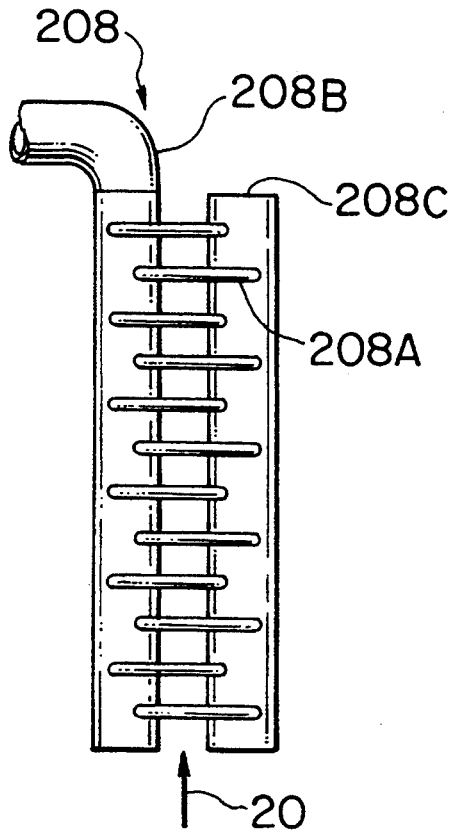
FIG. 4 is a front view of a first air cooler according to a second embodiment of the invention.
Figure 5:
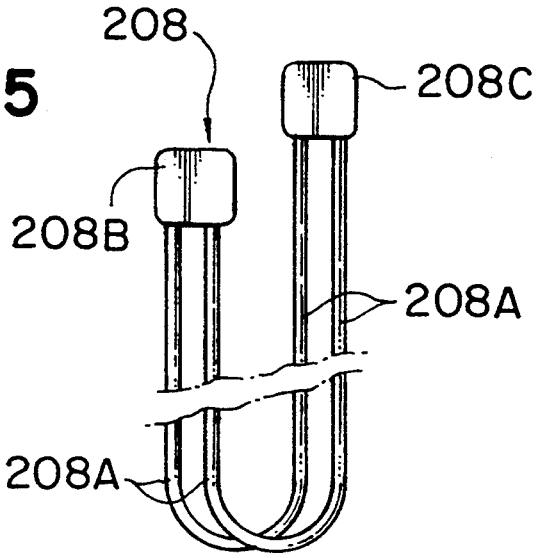
FIG. 5 is a plan view of the first air cooler of FIG. 4.

In the second embodiment of FIGS. 4 and 5, a first air cooler 208 includes a plurality of cooling pipes 208A mounted on headers 208B, 208C to be alternately displaced with respect to the adjacent pipe, for example, in a zigzag configuration in a direction perpendicular to a flowing direction of the cooling air 20, and are secured on the headers 208B, 208C by welding. Thus, in the embodiment of FIGS. 4 and 5, the plurality of cooling pipes 208A of the first air cooler 208 are arranged in a zigzag configuration, so that the efficiency of the operation of welding of the cooling pipes 208A can be further improved.

The remainder of the construction and other functions of the embodiment of FIGS. 4 and 5 are substantially the same as the embodiment of FIGS. 1–3.

Figure 6:
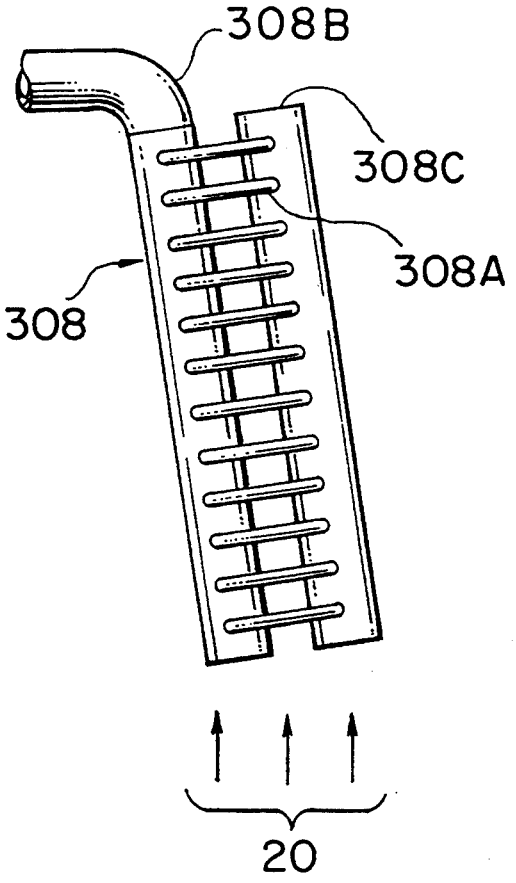
FIG. 6 is a front view of a first air cooler according to a third embodiment of the invention.

In the third embodiment of FIG. 6, a plurality of cooling pipes 308A of a first air cooler 308 are mounted on headers 308B, 308C to be slightly displaced with respect to the adjacent pipe of the downstream side of the cooling air 20 in a direction perpendicular to a flow direction of the cooling air 20, and are secured on the headers 308B, 308C by welding.

In the embodiment of FIG. 6, the cooling pipes 308A are displaced from one another with respect to the cooling air 20 so that the cooling pipes 308A are not adversely affected by heat discharged from the upstream cooling pipes 308A and turbulence of the cooling air 20. Therefore, heat exchange can be effected with a higher efficiency than the embodiment of FIGS. 1–3.

The remainder of the construction and other functions of the embodiment of FIG. 6 are substantially the same as the embodiment of FIGS. 1–3.

Figure 7:
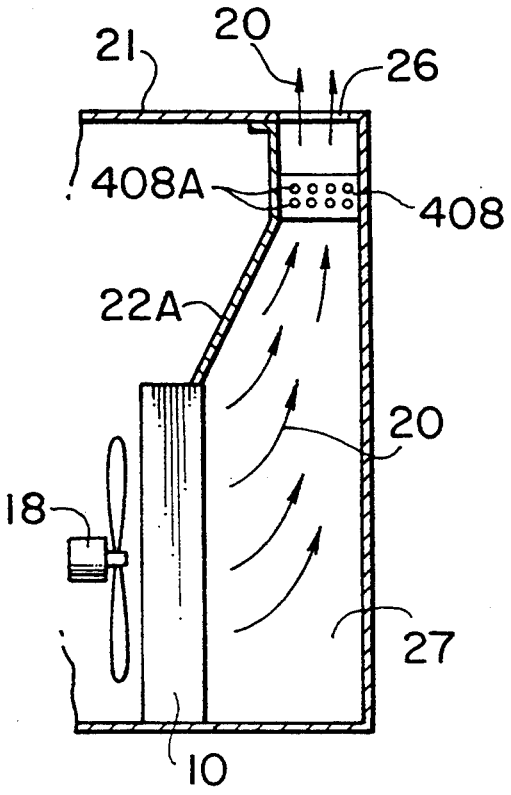
FIG. 7 is a side view of a fourth embodiment of the invention showing a shape of a cooling air discharge duct and an arrangement of a first air cooler, a second air cooler and so forth.

In the fourth embodiment of FIG. 7, a cooling air discharge duct 27 is shaped to have a cross-sectional area gradually reducing in a flow direction of the cooling air 20. An air-cooled oil cooler and coolant cooler (not shown) as well as a second air cooler 10 are arranged on the suction side of the cooling air discharge duct 27, and a first air cooler 408 is arranged on the discharge side of the duct 27.

In the embodiment of FIG. 7, the cooling air 20, which has been blown horizontally by a cooling fan 18, passes the second air cooler 10, the air-cooled oil cooler and the coolant cooler, and flows into the cooling air discharge duct 27. By the cooling air discharge duct 27, the cooling air 20 is directed vertically upwardly and also increased in flow velocity because the conveyer discharge duct 27 is shaped to have a cross-sectional area diminishing gradually in the air discharge direction. Consequently, the flow velocity of the cooling air 20 flowing around cooling pipes 408A of the first air cooler 408 disposed on the discharge side of the air discharge duct 27 is increased, so that the heat exchange efficiency can be increased.

The first air cooler 108 in the embodiment of FIGS. 1–3, or the first air cooler 208, 308 in the embodiments of FIGS. 4 and 5 and FIG. 6 may be applied to the embodiment of FIG. 7.

By virtue of the above noted features of the present invention, since the plurality of cooling pipes of the first air cooler are arranged along the flowing direction of the cooling air, the flow velocity of the cooling air flowing around the cooling pipes of the first air cooler can be largely increased, so that the compressed air flowing in the first air cooler and the cooling air can exchange heat with each other efficiently. As a result, it is possible to improve the heat exchange efficiency of the first air cooler, and accordingly, it is also possible to reduce the size of the first air cooler. Besides, it is not necessary to reduce the pitches of the cooling pipes of the first air cooler. Therefore, manufacturing problems in the welding and fixing operation of the cooling pipes can be solved.

Since the first air cooler is arranged at the discharge side of the cooling air which has passed the at least one of the second air cooler, the coolant cooler and the oil cooler, it is possible to improve the heat exchange efficiency of the first air cooler and to reduce its size and it is also possible to solve the manufacturing problems.

The cooling air discharge duct is provided such that the cooling air, which has been blown horizontally, is directed vertically upwardly at the discharge side, and the first air cooler is arranged in the cooling air discharge duct. Consequently, it is possible to improve the heat exchanger efficiency of the first air cooler and to reduce its size. It is also possible to reduce a space for the air discharge duct and to solve the manufacturing problem.

The plurality of cooling pipes of the first air cooler are mounted on the headers to be alternately displaced with respect to the adjacent pipes in a direction perpendicular to the flowing direction of the cooling air, so that the efficiency of the welding operation for attachment of the plurality of cooling pipes can be further improved.

The plurality of cooling pipes of the first air cooler are mounted on the headers to be slidably displaced with respect to the adjacent pipe of the downstream side in a direction perpendicular to the flowing direction of the cooling air, so that the cooling pipes are minimally affected by heat discharged from the upstream cooling pipes and turbulence of the cooling air. Therefore, heat exchange can be effected with a higher efficiency.

A portion of the cooling air discharge duct at the discharge side is shaped to have a cross-sectional area diminishing gradually in the flow direction of the cooling air, and the first air cooler is provided in this portion of the duct. Consequently, the flow velocity of the cooling air flowing around the cooling pipes is increased, to thereby make the heat exchange efficiency even higher.

What is claimed is:

1. An air-cooled oil-free rotary-type compressor comprising:

a first air cooler including a plurality of cooling pipes, a check valve, and a second air cooler, said first air cooler, said check valve and said second air cooler being disposed in a discharge passage for air compressed in a compressor body, said first and second air coolers being provided in a passage for cooling air including a cooling air discharge duct in which the cooling air, which has been blown horizontally past the second air cooler, is directed vertically upwardly at a discharge side of said discharge duct past the first air cooler, said first air cooler is disposed in said cooling air discharge duct, and at least a part of the first air cooler is disposed above the second air cooler.

2. An air-cooled oil-free rotary-type compressor comprising:

a first air cooler including a plurality of cooling pipes, a check valve, and a second air cooler, said first air cooler, said check valve and said second air cooler being provided in a passage of compressed air discharged from a compressor body, said second air cooler being disposed in a first cooling air flow direction and said first air cooler being disposed in a second cooling air flow direction substantially perpendicular to said first cooling air flow direction, and wherein said plurality of cooling pipes of the first air-cooler are arranged along the second cooling air flow direction and at least a part of the first air cooler is disposed above the second air cooler.

3. An air-cooled oil-free rotary-type compressor according to claim 2, wherein said plurality of cooling pipes of said first air cooler are mounted so as to be alternately displaced with respect to an adjacent pipe in a direction perpendicular to the second flow direction.

4. An air-cooled oil-free rotary-type compressor according to claim 2 wherein said plurality of cooling pipes of the first air cooler are mounted so as to be displaced with respect to an adjacent pipe on a downstream side of cooling air flowing past the second air cooler in a direction perpendicular to said second flow direction.

5. An air-cooled oil-free rotary-type compressor according to claim 2, wherein said plurality of cooling pipes of said first air cooler are arranged at a discharge side of the passage with the cooling air passing through at least one of the second air cooler, an air-cooled cooler for cooling a cooling liquid for cooling a casing of the compressor body, and an oil cooler for cooling a lubricating oil for lubricating bearings and gears within the compressor body before passing through the first air cooler.

6. An air-cooled oil-free rotary-type compressor according to claim 5, wherein said plurality of cooling pipes of the first air cooler are mounted so as to be alternately displaced with respect to an adjacent pipe in a direction perpendicular to the second flow direction.

7. An air-cooled oil-free rotary-type compressor according to claim 5, wherein said plurality of cooling pipes of the first air cooler are mounted so as to be displaced with respect to an adjacent pipe on a downstream side of cooling air flowing past the second air cooler in a direction perpendicular to said second flow direction.

8. An air-cooled oil-free rotary-type compressor comprising:

a first air cooler including a plurality of cooling pipes, a check valve, and a second air cooler, said first air cooler, said check valve and second air cooler being disposed in a discharge passage for air compressed in a compressor body, said first and second air coolers being provided in a passage for cooling air with said plurality of cooling pipes of the first air cooler being arranged along a flow direction of the cooling air, a cooling air discharge duct is included in said passage such that the cooling air, which has been blown horizontally past said second air cooler, is directed vertically upwardly at a discharge side of the discharge duct past said first air cooler, and said first air cooler is disposed in said cooling air discharge duct, and wherein a portion of said cooling air discharge duct at a discharge side has a cross-sectional area gradually reducing in a flow direction of said cooling air through said air discharge duct, and wherein said first air cooler is provided in said portion of said cooling air discharge duct.

9. An air-cooled oil-free rotary-type compressor in accordance with claim 8 wherein:

at least a part of the first air cooler is disposed above the second air cooler.

* * * * *